United States Patent [19]

Miller et al.

[11] 4,089,497

[45] May 16, 1978

[54] RAIL CAP

[76] Inventors: Curtis G. Miller, 2905 N. Bristol, Apt. L, Santa Ana, Calif. 92706; Craig S. Miller, 1221 S. Marine, Santa Ana, Calif. 92704

[21] Appl. No.: 763,306

[22] Filed: Jan. 28, 1977

[51] Int. Cl.[2] ..... A47B 95/00

[52] U.S. Cl. ..... 248/345.1; 5/93 R; 5/279 R; 5/353.3; 5/353.6; 248/118; 297/218; 297/411

[58] Field of Search ..... 5/93 R, 279 R, 286, 5/353.1, 353.2, 353.5, 353.6, 365; 248/118, 345.1; 297/194, 218, 227, 411

[56] References Cited

U.S. PATENT DOCUMENTS

| | | | |
|---|---|---|---|
| 1,756,694 | 4/1930 | Loehr | 248/118 X |
| 2,564,386 | 8/1951 | Webb | 5/93 R |
| 2,636,189 | 4/1953 | Feldman | 5/93 R |
| 3,273,178 | 9/1966 | Baruth et al. | 297/218 X |
| 3,596,989 | 8/1971 | Van Ryn et al. | 5/353.1 X |
| 3,747,178 | 7/1973 | Harder | 297/218 X |

FOREIGN PATENT DOCUMENTS

| | | | |
|---|---|---|---|
| 317,481 | 11/1969 | Sweden | 297/218 |

*Primary Examiner*—James C. Mitchell
*Attorney, Agent, or Firm*—Richard L. Myers

[57] ABSTRACT

A cap adapted for use with an elongated rail having a pair of opposed lateral surfaces includes a support member having laterally opposed walls which extend along the lateral surface of the rail. A resiliently compressible material is disposed over the support member and held in place by a cover. Opposed marginal portions of the cover are bent around respective troughs formed by the walls of the support member, and each marginal portion is retained within the associated trough by a spline. The walls of the support member bias the cover into frictional engagement with the lateral surfaces of the rail to retain the cap on the rail.

18 Claims, 6 Drawing Figures

11
2
2
15
25
13
17

29
35
37
25
45
43
19
31
33
41
27
39
40
49
51
47
53
38
23
21
17

45
47
49

29
43
33
39
31
41
27
40
19
51
38
53
23
17

33
43
55
57
53
40

37
44
42
33
54
53

37
44
42
27
41
61
63
59

RAIL CAP

BACKGROUND OF THE INVENTION

1. Field of Invention

This invention relates generally to rail caps and more specifically to caps adapted for use with bed frame rails.

2. Discussion of the Prior Art

Table tops are usually provided with edges which typically present a relatively hard, narrow surface. A person leaning on such an edge for an extended period of time will experience considerable discomfort due to the configuration of this edge region. To alleviate this discomfort, it has been desirable in some cases to provide a cap having resiliently compressible properties and being adapted to fit over these edge regions to present a softer, wider surface. These caps have been somewhat elaborate in their construction and typically they have had to be permanently fixed to the table edge for example using nails or screws. In most cases, these caps have been designed to fit over a substantial portion of the top edge of the table as well as the side edge of the table.

With these characteristics, the caps of the past have not been particularly adapted for use with upstanding rails or planks such as those associated with the frames of water beds. These rails, which are typically 2 × 10 planks, form a bladder cavity within which the bladder of a watermattress can be disposed.

Due to the fluid nature of a water bed, a person sitting on the edge of the bed is supported primarily by the relatively hard, upstanding bed frame rail. Due to its narrow configuration, the rail tends to exert a considerable pressure on the person with resulting discomfort. For this reason, it is desirable to provide these rails with caps which present a relatively broader, softer surface. This will not only make it more comfortable to sit on the edge of the bed, but will substantially reduce the risk of injury to a person sleeping on the bed who might inadvertently come in contact with the rails of the bed frame.

SUMMARY OF THE INVENTION

In accordance with the present invention, a cap is provided for use with a rail or plank or any substantially hard surface presenting a relatively narrow edge. This cap can be formed as a complete assembly and can be fixed to the rail without the use of any nails or screws.

The cap includes a support member having opposed walls which are biased toward each other and adapted to fit over the edge of the rail. A resilient material such as foam or cotton can be disposed over this support member and retained in place by a cover having marginal portions. Each of the free edges of the walls of the support member can be configured to form a trough extending inwardly of the associated wall and adapted to receive the associated marginal portion of the cover. Retaining splines can be disposed within these troughs to engage the marginal portions of the cover and thereby hold the cover, the resilient material, and the support member in a single assembly. With the walls of the support member biased toward each other, they tend to force the marginal portions of the cover into frictional engagement with the lateral surface of the rail to retain the cap on the edge of the rail.

These and other features and advantages of the present invention become more apparent with a discussion of the preferred embodiments of the invention and reference to the associated drawings.

DESCRIPTION OF PREFERRED EMBODIMENTS

Figure 1:
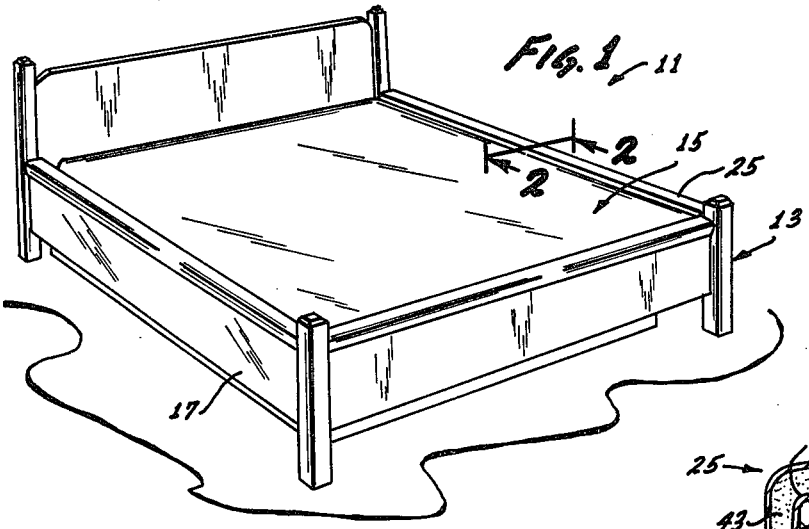
FIG. 1 is a perspective view of a water bed including upstanding frame rails and one embodiment of a cap of the present invention disposed along the tops of the rails.

A water bed is illustrated in FIG. 1 and designated generally by the reference numeral 11. The water bed 11 typically includes a bed frame 13 which forms a cavity to receive a water bladder or mattress 15.

The bed frame 13 is typically formed by a plurality of upstanding planks or rails 17 which are connected at their ends to form the cavity for the mattress 15. In a typical water bed 11, the rails 17 are formed from 2 × 10 boards which present a relatively, narrow top surface 19 and a pair of opposed lateral surfaces 21 and 23 which extend downwardly from the surface 19.

It is of particular importance to note with respect to the present invention that the top surface 19 may have a width of only 1½ inches so that a person sitting on the edge of the water bed 11 will have a substantial portion of his weight supported over a particularly limited area. As a result, there is a substantial pressure exerted on a person in this position which results in considerable discomfort. It is therefore particularly desirable that this surface be provided with an increased surface area as well as surface characteristics which are softer than those associated with the rail 17.

These same characteristics can be desired at the edge of a table or substantially any member presenting a relatively hard, narrow surface with which a person might come in contact. For this reason, the term "rail" as used herein refers to any such member presenting a relatively hard surface such as the top surface 19.

In accordance with the present invention, a cap 25 is provided to fit in tight frictional engagement with the rail 17 to present a broader and substantially softer surface to the edge of the rail 17. In a preferred embodiment, the cap 25 includes a support member 27 which is adapted to extend along the length of the rail 17.

The support member 27 is adapted to fit over the surface 19 and along a portion of the lateral surfaces 21 and 23. In cross-section, the support member 27 has generally a U-shape configuration formed by a particular wall 29 which extends between a pair of lateral walls 31 and 33. Thus the particular wall 29 is connected to the lateral wall 31 along a longitudinal edge 35 and is connected to the lateral wall 33 along a longitudinal edge 37. When the cap 25 is mounted on the rail, the particular wall 29 of this embodiment is in surface contact with the top surface 19 of the rail 17. With the particular wall 29 having substantially the width of the surface 19, the lateral walls 31 and 33 of the support member 27 extend substantially along the associated lateral surfaces 21 and 23 of the rail 17.

In a preferred embodiment, mariginal portions 38 and 40 of the lateral walls 31 and 33 respectively are curled inwardly to form a pair of troughs 39 and 41 respectively. Thus, the wall 31 is curled in the direction of the wall 33 to form the trough 39, and the wall 33 is curled in the direction of the wall 31 to form the trough 41. The troughs 39 and 41 open inwardly of the U-shaped support member 27 along the length thereof. The curls forming the troughs 39 and 41 may be substantially circular in cross-section.

The support member 27 can be formed from a generally rigid material having characteristics permitting the lateral walls 31, 33 to be bent outwardly with a substantial force which biases the walls 31 and 33 toward each other. In a preferred embodiment, the support member 27 is formed from a generally, rigid, plastic vinyl material such as styrene.

In a preferred embodiment, the walls 31 and 33 may extend substantially perpendicular to the particular wall 19 in a generally free state. However, the portions of the walls 31 and 33 forming the troughs 39 and 41 respectively may be separated by a distance less than the width of the particular wall 29. As a result, when the cap 25 is disposed over the rail 17, the portions forming the troughs 39 and 41 are forced outwardly to exert a biasing force on the lateral surfaces 21 and 23 of the rail 17.

A compressible, resilient material such as foam rubber 43 can be disposed to substantially cover the particular wall 29 and portions of the lateral walls 31 and 33 along the length of the cap 25. This material will not only widen the surface of the particular wall 29 but will provide relatively softer characteristics along the surface of the cap 25. To retain the foam rubber 43 in place, a cover 45 can be disposed over the surface of this resilient material. The cover 45 can be formed for example from a woven fabric or vinyl.

The cover 45 includes marginal portions 47 and 49 which can be curled around the marginal portions 38 and 40 respectively of the walls 31 and 33 respectively. These marginal portions 47 and 49 of the cover 45 can be folded into the troughs 39 and 41 and retained in this preferred position by a pair of splines 51 and 53 respectively. The splines 51 and 53 can be disposed in the troughs 39 and 41 respectively at selected points along the length of the support member 27. However, in a preferred embodiment the splines 51 and 53 extend along substantially the entire length of the support member 27. These splines 51 and 53 can be formed from wood and can be provided with a width sufficient to force the marginal portions 38 and 40 into an expanded state such that the walls of the troughs 39 and 41 pinch the marginal portions 47 and 49 against the splines 51 and 53 respectively.

Figure 4:
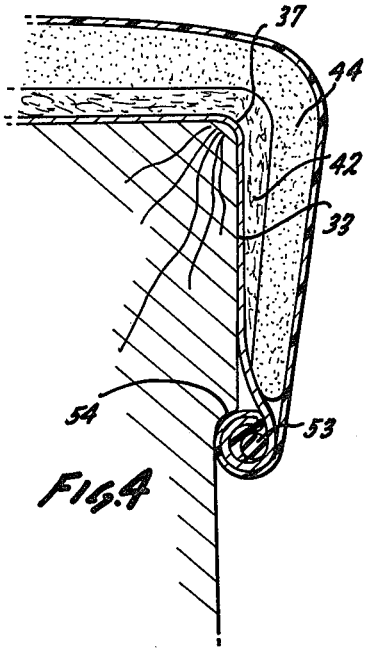
FIG. 4 is a cross-sectional view similar to FIG. 2 of another form of a different embodiment of the rail cap of the present invention.

A further embodiment of the invention is illustrated in FIG. 4. In this embodiment, as well as those illustrated in FIGS. 5 and 6, only that portion of the cap 25 associated with the trough 41 is illustrated. It will be understood, however that the opposite portions of the cap 25 can be similarly constructed.

Figure 2:
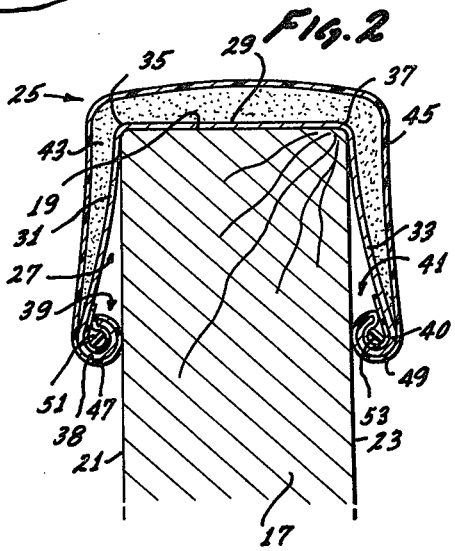
FIG. 2 is a cross-sectional view of the rail cap of the present invention taken along lines 2—2 of FIG. 1.
Figure 3:
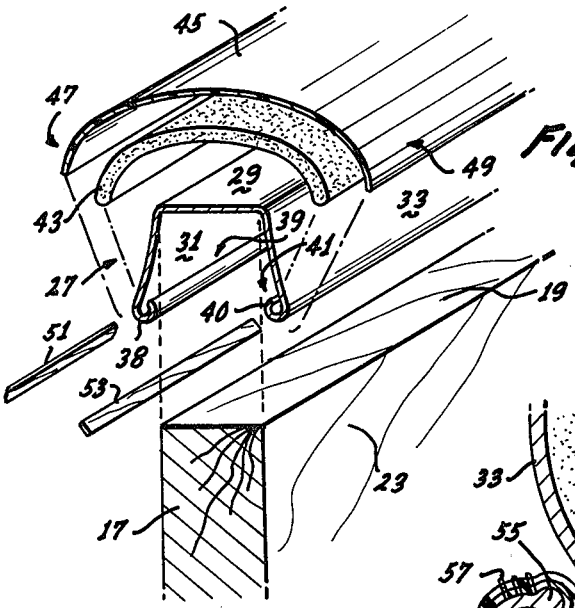
FIG. 3 is an expanded perspective view of a form of one embodiment of the cap rail of the present invention.

The embodiment of FIG. 4 is similar to that discussed with reference to FIGS. 2 and 3 except that the resilient material between the support member 27 and the cover member 45 includes a first resilient material 42 and a second resilient material 44. In this embodiment, it may be desirable that the first material 42 have a greater resistance to compression and perhaps less resiliency than the second material 44. This will even further reduce the sharpness of the longitudinal edges 35 and 37 associated with the support member 27. In a preferred form of this embodiment of the invention, the material 42 is formed from cotton and the resilient material 44 is formed from foam rubber.

In another aspect of this embodiment, the spline 53 is provided with a generally circular cross-section which is particularly suitable if the trough 41 has a circular cross-section. The spline 53 can be formed from a resilient material such as rubberized vinyl. This type of spline is commonly used in the construction of window and door screens. The resilient qualities as well as the rubberized nature of this spline 53 may increase the holding qualities of the spline 53 in this embodiment.

Also illustrated in FIG. 4 is a notch 54 in the lateral surface 23 of the rail 17. This notch 54 extends along the length of the rail 17 at a position to receive the curled edge portions of the cap 25. Thus the notch 54 provides means for inhibiting the removal of the cap 25 once it has been mounted on the rail 17. Removal of cap 25 is opposed by the wall 33 which is forced outwardly by the camming action of the curled edge on the notch 54.

Figure 5:
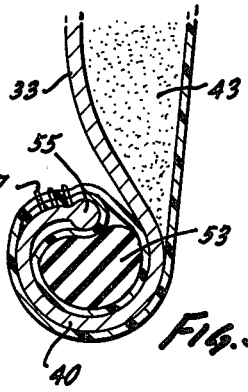
FIG. 5 is a cross-sectional view similar to FIG. 2 of another form of an additional embodiment of the rail cap of the present invention.

Another embodiment of the present invention is illustrated in the fragmentary cross-sectional of FIG. 5. In this embodiment, it will be noted that the marginal portion 40 of the wall 33 is provided with a lip or bead 55 which extends along the entire free edge of the wall 33. Thus the bead 55 extends at least partially into the trough 41 to inhibit the removal of the cover 45 and associated spline 53.

In some instances it has been found desirable to fix the spline 53 to the marginal portions 49 of the cover 45 prior to their insertion into the trough 41. In the illustrated embodiment, the spline 53 is sewn into the marginal portion 49 of the cover 45 as illustrated by the stitches 57.

Figure 6:
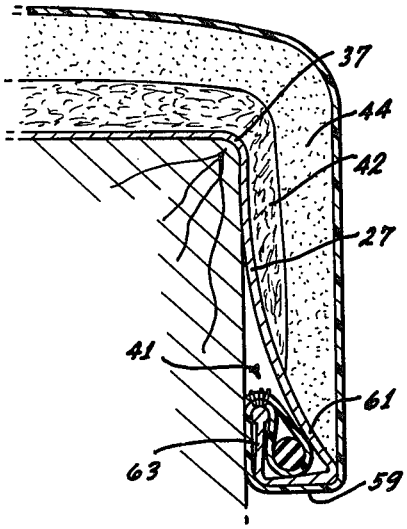
FIG. 6 is a cross-sectional view similar to FIG. 2 of still another form of an embodiment of the rail cap of the present invention.

In a further embodiment of the invention illustrated in FIG. 6, the trough 41 has more of a squared shape in cross-section. This trough 41 is formed by a bottom flange 59 which is connected between an outer flange 61 and an inner flange 63. The bead 55 can be provided as in the previous embodiment along the free edge of the flange 63. In this embodiment, the flanges 59, 61, and 63 can be integral with the support member 27, and the outer flange 61 can be an extension of the lateral wall 33.

It has been found that when the marginal portion 49 of the cover 45 and the spline 53 are inserted into the trough 41, the inner flange 63 is bent away from the outer flange 61. This bending can be facilitated by reducing the cross-sectional area of the junction between the bottom flange 59 and the inner flange 63. This facilitates the construction of the cap 25.

On the other hand, it has been found that any force tending to remove the spline 53 from the trough 41 raises the inner flange 63 in FIG. 6, to produce a bending movement at the junction between the bottom flange 59 and the outer flange 61. It has been found that these removing forces can be resisted by increasing the cross-sectional area of the support member 27 at this junction. Thus, the junction with the bottom flange 59 can be made relatively stronger at the outer flange 61 and relatively weaker at the inner flange 63 to facilitate insertion of the spline 53 into the trough 41 while inhibiting removal of the spline 53 from the trough 41.

These embodiments of the invention can be constructed of readily available materials which are easily assembled to provide a single unit. This unit can be easily mounted into frictional engagement with the edge of a rail, such as the rail 17, to provide a relatively softer and wider surface area. The troughs 39 and 41 not only aid in the frictional engagement of the rail 17, but also provide excellent retention characteristics for the marginal portions 47 and 49 of the cover 45. These characteristics can be enhanced by the use of a resilient spline 53, the bead 55, or by stitching the spline 53 into the marginal portions 49 of the cover 45.

Although the invention has been described with reference to specific embodiments, it will be apparent that the invention can be otherwise embodied so that the scope of the invention should be ascertained only with reference to the following claims.

I claim:

1. A cap adapted for use with an elongated member having a lateral surface extending along the member, the cap including:

support means adapted to fit over at least a portion of the member and including an elongated wall extending along the member and being biased in the direction of the lateral surface of the member for retaining the support means in a substantially fixed relationship with the elongated member;

resilient means covering at least a portion of the support means including at least a portion of the elongated wall of the support means and having characteristics for being resiliently compressed at least in the direction of the support means;

surface means having a marginal portion and being adapted to cover at least a portion of the resilient means and the support means including the elongated wall of the support means, the surface means forming the outer surface of the cap;

an edge portion of the support means forming a trough disposed along the elongated wall of the support means, the edge portion being biased by the support means toward the lateral surface of the elongated member;

the surface means being bent around the edge portion of the support means with the marginal portion of the surface means extending into the trough;

retention means for engaging the marginal portion of the surface means within the trough for retaining the surface means in the covering relationship with the resilient means; whereby the marginal portions of the surface means are biased by the support means into frictional engagement with the lateral surface of the elongated member to retain the cap on the elongated member.

2. The cap set forth in claim 1 wherein the edge portion of the support means is adapted to extend along the lateral surface of the elongated member, the edge portion including at least a first flange, a second flange extending inwardly of the first flange, and a third flange extending from the second flange along the first flange to form the trough.

3. The cap recited in claim 1 wherein the edge portion of the support means is adapted to extend along the lateral surface of the elongated member and the trough has in cross-section a substantially circular configuration.

4. The cap set forth in claim 1 wherein the retention means includes an elongated spline which is disposed entirely within the trough to engage the marginal portion of the surface means within the trough.

5. The cap recited in claim 1 wherein the edge portion of the support means has a particular edge which is disposed inwardly of the elongated wall along the length of the support means and the cap further comprises means disposed along the particular edge to form a lip which extends into the trough for inhibiting removal of the surface means from the trough.

6. A combination adapted for use with a rail having an elongated configuration and being defined by a particular surface, a first lateral surface, and a second lateral surface, the combination including:

a support member adapted to engage the rail and having a first wall extending generally along the first lateral surface of the rail and a second wall extending generally along the second lateral surface of the rail, the first wall being biased toward the first lateral surface of the rail to pinch the rail between the first wall and the second wall of the support member;

means disposed along the edge of at least one of the first wall and the second wall of the support means for forming a trough opening inwardly of the one wall;

resilient means covering at least a portion of the support member and having characteristics for being resiliently compressed at least in the direction of the support member;

a cover disposed over the resilient means and around the trough forming means, the cover including marginal portions which extend into the trough; and means cooperating with the trough for retaining the marginal portions of the cover in a substantially fixed relationship with the one wall.

7. The combination recited in claim 6 wherein the retaining means is disposed in the trough and the means forming the trough is resiliently biased to retain the support members and the marginal portions of the cover within the trough.

8. The combination set forth in claim 7 wherein the retaining means is circular in cross-section and has characteristics for being compressed within the trough.

9. The combination recited in claim 6 wherein the second wall of the support member is adapted to extend along the second lateral surface of the rail and is biased toward the first wall of the support member to pinch the rail between the first wall and the second wall of the support member.

10. The combination recited in claim 6 wherein the means for forming the trough includes a bottom flange connected to an inner flange and an outer flange, and the outer flange comprises an extension of the one wall of the engaging means.

11. The combination set forth in claim 10 wherein the connection of the bottom flange of the trough to the outer flange of the trough is relatively stiffer than the connection of the bottom flange of the trough to the inner wall of the trough to facilitate insertion of the retention means into the trough while inhibiting removal of the retention means from the trough.

12. The combination recited in claim 6 further comprising means for fixing the marginal portion of the cover to itself and around the retention means.

13. In combination:

a support member including a first elongated wall defined by a first edge and a second edge, a second elongated wall connected to the first elongated wall at the first edge thereof, and a third elongated wall connected to the first elongated wall at the second edge thereof, the second and third walls extending in spaced relationship to each other on the same side of the first wall;

means for forming a first trough along the second wall at an unconnected edge thereof, the first trough opening inwardly of the second wall along the length of the second wall;

means for forming a second trough along the third wall at an unconnected edge thereof, the second trough opening inwardly of the third wall along the length of the third wall;

resilient means for covering at least a portion of the first wall, the second wall, and the third wall;

cover means having first marginal portions and second marginal portions, the cover means disposed over the resilient means with the first marginal portion extending into the first trough and the second marginal portion extending into the second trough;

means engaging the first marginal portion of the cover means within the first trough and engaging the second marginal portion of the cover means within the second trough for retaining the cover means, the resilient means, and the support member in a substantially fixed relationship.

14. The combination set forth in claim 13 wherein the means for forming the first trough is biased in the direction of the second wall to pinch the engaging means and the first marginal portion of the cover means within the first trough.

15. The combination recited in claim 13 wherein the resilient means includes:

a first resilient material disposed in contiguous relationship to the support member;

a second resilient material disposed between the first resilient material and the cover means; and the first resilient material having a higher resistance to compression than the second resilient material.

16. The combination set forth in claim 13 wherein the means for forming the first trough has a free edge and the combination further comprises means disposed along the free edge to form a lip which extends into the first trough for inhibiting removal of the cover means from the trough.

17. In combination:

a rail defined by a particular surface having a particular width and first and second lateral surfaces depending from the particular surface and being separated by the particular width;

means defining at least one notch extending along the first lateral surface longitudinally of the rail in spaced relationship to the particular surface, the notch being spaced from the second lateral surface by a distance less than the particular width;

a cap disposed in a preferred position over the rail to cover at least a portion of the particular surface and first and second lateral surface, the cap having characteristics of softness and resiliency greater than those of the material forming the rail;

a support member included in the cap and having a particular wall disposed in proximity to the particular surface of the rail and first and second walls depending from the particular wall and being disposed in proximity to the first and second surfaces respectively of the rail;

retention portions of the support member extending inwardly from the first wall longitudinally thereof; and the first wall of the support member having resilient characteristics for biasing the retention portions into the notch so that the cap snaps into its preferred position when installed on the rail and removal of the cap from the rail is opposed by a camming action of the retention portions along the first surface which tends to separate the first and second walls a distance greater than the particular width.

18. The combination recited in claim 17 wherein the cap includes a cover and the retention portions of the support member include means for retaining the cover and the support member in a fixed relationship.

* * * * *